US009120238B2

(12) United States Patent
Mikula et al.

(10) Patent No.: US 9,120,238 B2
(45) **Date of Patent: *Sep. 1, 2015**

(54) HAIR TRIMMER DEVICE WITH COMB UNIT

(75) Inventors: Christian Mikula, Wernberg (AT); Gerald Kauer, Ferlach (AT); Harald Duller, Klagenfurt (AT)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 254 days.

This patent is subject to a terminal disclaimer.

(21) Appl. No.: 13/251,942

(22) Filed: Oct. 3, 2011

(65) Prior Publication Data

US 2012/0137524 A1 Jun. 7, 2012

Related U.S. Application Data

(63) Continuation of application No. 11/909,826, filed as application No. PCT/IB2006/050834 on Mar. 17, 2006, now Pat. No. 8,028,422.

(30) Foreign Application Priority Data

Mar. 31, 2005 (EP) ..... 05102534

(51) Int. Cl.
*B26B 19/38* (2006.01)
*B26B 19/20* (2006.01)

(52) U.S. Cl.
CPC ..... *B26B 19/20* (2013.01)

(58) Field of Classification Search
CPC ..... B26B 19/20
USPC ..... 30/199, 200, 208, 216, 233.5
See application file for complete search history.

(56) References Cited

U.S. PATENT DOCUMENTS

| | | | | | |
|---|---|---|---|---|---|
| 1,602,252 | A | * | 10/1926 | Ritzmann | 30/199 |
| 1,807,811 | A | * | 6/1931 | Van Osdel | 30/200 |
| 1,997,096 | A | * | 4/1935 | Andis | 30/199 |
| 2,182,597 | A | * | 12/1939 | Oster | 30/210 |
| 2,547,288 | A | * | 4/1951 | Sandlie | 30/537 |
| 2,731,720 | A | * | 1/1956 | Henard | 30/201 |
| 2,874,463 | A | * | 2/1959 | Andis | 30/200 |
| 3,116,550 | A | * | 1/1964 | Mariano De-Paoli | 30/537 |
| 3,651,570 | A | * | 3/1972 | Groves | 30/233 |
| 3,969,819 | A | * | 7/1976 | Pepera | 30/200 |
| 4,493,154 | A | * | 1/1985 | Pascual | 33/631 |
| 5,092,048 | A | * | 3/1992 | Sukow et al. | 30/210 |
| 5,325,590 | A | * | 7/1994 | Andis et al. | 30/216 |
| 5,970,616 | A | * | 10/1999 | Wahl et al. | 30/216 |
| 6,276,060 | B1 | * | 8/2001 | Faulstich et al. | 30/34.1 |
| 6,317,982 | B1 | | 11/2001 | Andrew | |
| 6,378,210 | B1 | * | 4/2002 | Bickford | 30/43.92 |

(Continued)

FOREIGN PATENT DOCUMENTS

| | | | |
|---|---|---|---|
| EP | 0 925 886 | A1 * | 6/1999 |
| EP | 1 216 799 | A2 * | 6/2002 |

*Primary Examiner* — Hwei C Payer

(57) ABSTRACT

To allow trimming body hair by pulling as well as pushing with the same hair trimmer device (1), its comb unit (6) is positioned over the trimming head (16) in at least two different positions (8, 9), one (8) pulling and one pushing position (9). In particular, in the different comb positions (8, 9), the tips (20) of the comb unit's fins (13) point in the direction of the respective movement. Preferably, the comb unit (6) is removably attached. In a preferred embodiment, the trimming head (16) includes shaving means (18) besides trimming means (19).

13 Claims, 6 Drawing Sheets

(56) References Cited

U.S. PATENT DOCUMENTS

Figure 1A:
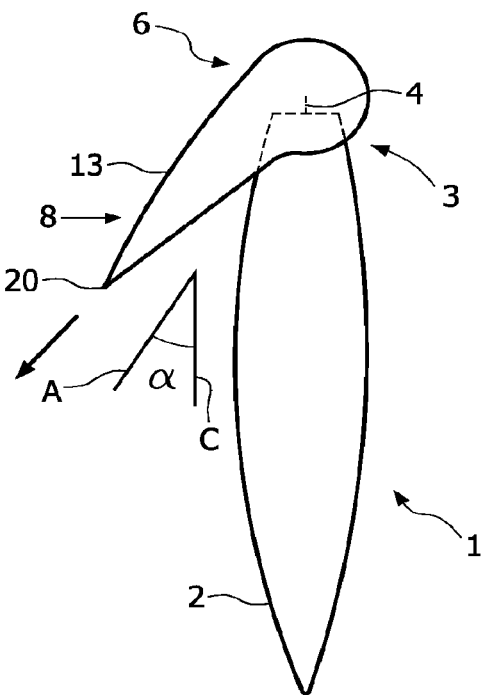

| | | | | |
|---|---|---|---|---|
| 6,505,404 | B2 * | 1/2003 | Ullmann | 30/216 |
| D574,557 | S * | 8/2008 | Kling et al. | D28/54 |
| 8,028,422 | B2 * | 10/2011 | Mikula et al. | 30/216 |
| 8,141,253 | B2 * | 3/2012 | Royle | 30/34.05 |
| 2002/0000043 | A1 * | 1/2002 | Beutel et al. | 30/216 |
| 2008/0047145 | A1 * | 2/2008 | Dietzel et al. | 30/34.05 |
| 2012/0137524 | A1 * | 6/2012 | Mikula et al. | 30/34.1 |

* cited by examiner

HAIR TRIMMER DEVICE WITH COMB UNIT

This application is a continuation of U.S. patent application Ser. No. 11/909,826, now U.S. Pat. No. 8,028,422, filed on Sep. 27, 2007, entitled "Hair Trimmer Device With Comb Unit," which is a National Stage Entry of PCT Application PCT/IB2006/050834, filed Mar. 17, 2006, which claims priority to European Patent Application 05102534.4, filed Mar. 31, 2005. The entire disclosures of the prior applications are considered as being part of the disclosure of the accompanying application and are hereby expressly incorporated by reference herein.

The present invention relates to a hair trimmer device with a main body, a trimming head and a removable comb unit arranged on the trimming head. The present invention further relates to a comb unit for usage with such a hair trimmer device.

Apart from trimming hair on the head and on the face by cutting and/or shaving it, for some groups of users the need has arisen to remove body hair on different body zones, for example on the legs, the arms, the chest, in the armpit or pubic hair by cutting and/or shaving. These body zones can be quite difficult to access and may be very sensitive. Thus, the risk of accidentally injuring the skin has to be minimized. One possibility is to use different directions of movement. Sometimes it can be easier to remove hair by pulling a device, sometimes it can be easier to remove hair by pushing a device. For higher customer satisfaction it should be possible to have one single device for different kinds of applications, like pulling and pushing.

Hair clipping devices allowing different applications are already known, as for example the hair clipping device according to EP 1 216 799 A2, allowing gross trimming in a first position of a rotatable bladeset and fine trimming in a second position of the rotatable bladeset.

In more detail, EP 1 216 799 A2 discloses a hair clipping device with a rotating bladeset having multiple cutting edges. The bladeset includes at least one stationary blade and one moving blade configured for reciprocal movement relative to the at least one stationary blade. The stationary blade has a first cutting edge and a second cutting edge. The moving blade includes a first moving edge configured for reciprocal movement relative to the first cutting edge, and a second moving edge configured for reciprocal movement relative to the second cutting edge. The respective cutting edges are preferably in a back-to-back relationship to each other, the edges on the one side being narrow for fine trimming and the edges on the other side being wide for gross trimming The bladeset is rotatably engageable on the housing between a first position, in which the wide edges are employed, and a second position, in which the narrow edges are employed. This provides the user with the capability of selectively performing either gross or fine trimming Advantageously, the housing of the hair clipping device is configured so that the user may maintain a single gripping position regardless of whether the bladeset is in the position for using the wide edges or in the position for using the narrow edges. A replaceable attachment comb is used for assisting the user in obtaining hair cut to a uniform length.

The bladeset being rotatably engageable necessitates a complicated mechanism for ensuring that the moving blade is driven by the electric motor arranged in the housing of the hair clipping device, and for ensuring that the bladeset is secured in the wanted position. Complicated mechanisms are prone to malfunctioning due e.g. to clogging with hair clips or to wear, and increase manufacturing costs.

The object of the present invention is to improve a hair clipping device such that the said disadvantages of the known arrangement are avoided, while it allows trimming by a pulling movement as well as a pushing movement.

This object is achieved by a hair trimmer device with a main body, a trimming head and a comb unit arranged on the trimming head, characterized in that the comb unit can be positioned in at least two different positions, in the first of which the hair trimmer device is to be pulled, and in the second of which the hair trimmer device is to be pushed.

By only changing the comb unit's position the user may switch between a pulling and a pushing application of the device according to the invention. The comb unit may be removably or irremovably attached to the trimming head and/or the main body. Attaching means may be provided on the comb unit and/or the trimming head and/or the main body. Any way of attachment known in the art may be used, for example snapping, screwing, clamping etc. to name only some of the most usual possibilities. Many ways of attachment of comb units are known in the art that are achieved with only few and simple mechanical provisions.

In case of a removable comb unit, the comb unit may preferably be removed and reattached for changing between different positions, in case of an irremovable comb unit, the comb unit may preferably be pivoted, to make the change of positions as easy as possible for the user.

In preferred embodiments, the comb unit includes fins and the comb unit is positioned in at least two positions such that the tips of the fins point in the pulling or pushing direction respectively. Thus, while trimming, the contact between skin and hair on the one hand and the hair trimmer device on the other is made via the comb unit with its fins touching the skin. Actually, the orientation of the fins defines the direction of the pulling or pushing movement. Furthermore, by having the fins' tips pointing in the direction of the movement, it is made sure that the comb unit is used most efficiently, because the fins' tips penetrate the hair to be trimmed in a first place and make it stand upright for achieving a uniform cut of all hair reachable by the comb unit.

It will be noted that by switching between positions with the fins' tips pointing in one and in another direction, the comb unit can be designed much more compact than a comb unit being able to be positioned only in one single position, but allowing both a pulling and a pushing movement by having fins being oriented in at least two different directions. Such a bulky comb unit would not be handy, as it would reduce accessibility in narrow regions of body zones to be trimmed.

Advantageously, the comb unit includes fins and the angle between the axis defined by the orientation of the fins and the axis defined by the main body is smaller in the comb unit's pulling position than in the comb unit's pushing position. The inventors have found out that from an ergonomic point of view, for most users a smaller angle is more convenient for pulling a hair trimmer device than for pushing a hair trimmer device.

Preferably, the angle between the axis defined by the orientation of the fins and the axis defined by the main body is between about 0° and 40° in the comb unit's pulling position and between about 30° and 70° in the comb unit's pushing position. The optimal angles depend on the size and proportions of the actual user, especially of his/her arm length in relation to the body zone to be trimmed.

The ergonomics of the device according to the present invention is further enhanced if the angle between the axis defined by the orientation of the trimming head and the axis defined by the main body is larger than 0°. Angles in the range between 50° and 70° are preferred. By having the trimming head off the axis of the main body, the accessibility of narrow and/or curved body zones is improved, such as for example arm pits or legs.

Preferably, the trimming head includes at least one trimming means. The one or more trimming means may be any means capable of cutting or otherwise removing hair, for example single blades, bladesets with a stationary blade and a moving blade doing a reciprocal linear movement relative to the stationary blade, rotating blades, vibrating blades, or more exotic means like laser beams etc.

In preferred embodiments, the trimming head includes two trimming means, one for use in a pulling application and the other for use in a pushing application. Preferably, they are arranged on the trimming head with a certain distance to each other and with different orientations adapted for better cutting or hair removing efficiency in the respective direction of application.

Advantageously, the trimming head includes at least one shaving means. This allows multifunctional hair trimmer devices to completely remove any body hair by cutting and/or shaving.

In preferred embodiments, the trimming head has a shaving means arranged between two trimming means. This particular trimming head makes it possible to first cut the body hair to be removed very thoroughly by a pulling or a pushing movement with the help of the comb unit and then to easily remove the remaining stubbles by shaving them.

The object of the present invention is further achieved by a removable attachment comb unit for use with a hair trimmer device as described before. One advantage of removable attachment combs is that combs of different sizes and different inclinations of the fins may be provided to adapt the optimal angles between the directions of movement and the axis of the main body. The user may then choose his/her appropriate comb unit depending on the user's size and from which body zone the hair is to be removed, i.e. the user may choose the comb unit he/she feels most comfortable with, when using the hair trimmer device according to the present invention.

It will be noted that the comb unit may be a single-component comb unit or a multiple-component comb unit, e.g. for providing different cut lengths.

Figure 1B:
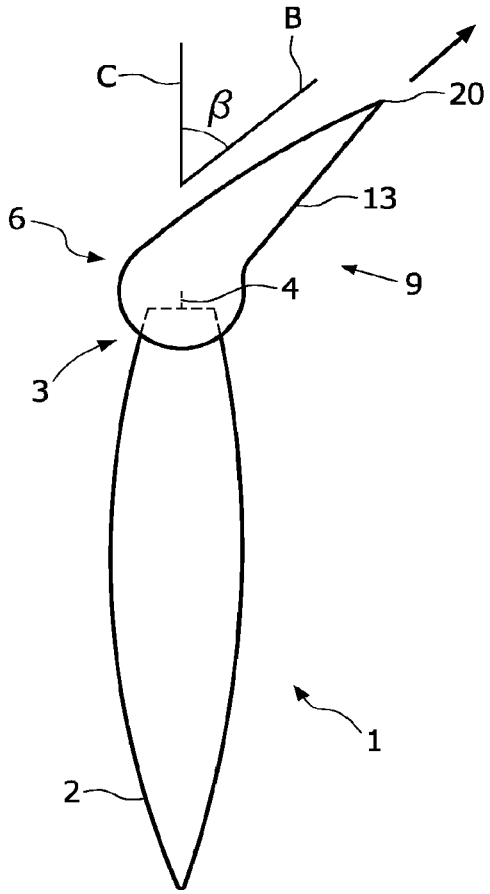
Figure 2A:
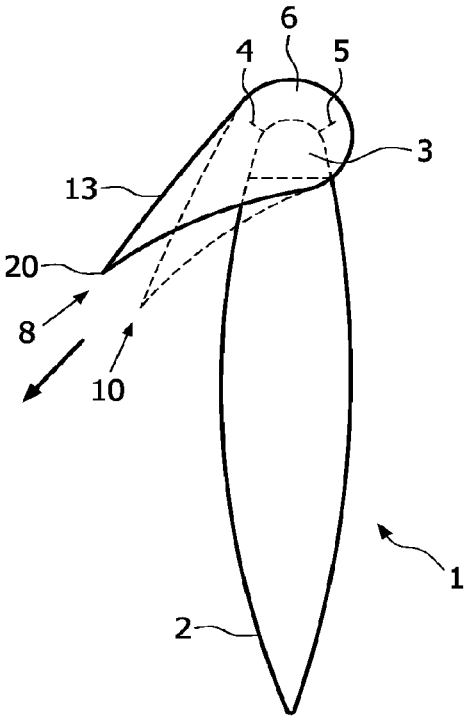
Figure 2B:
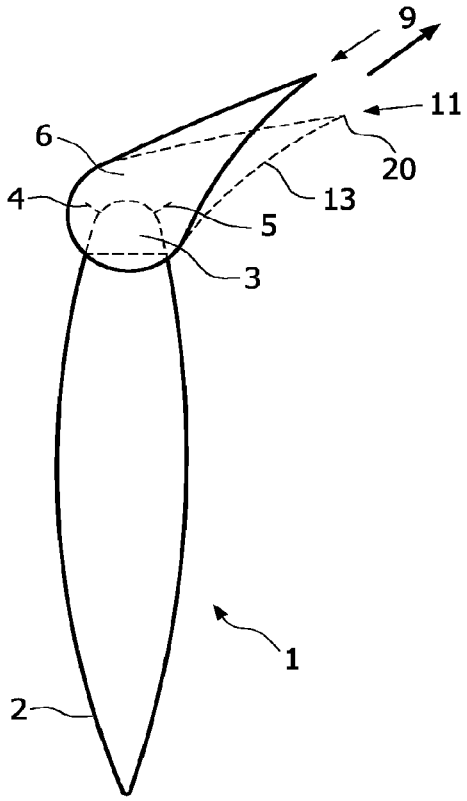
Figure 3A:
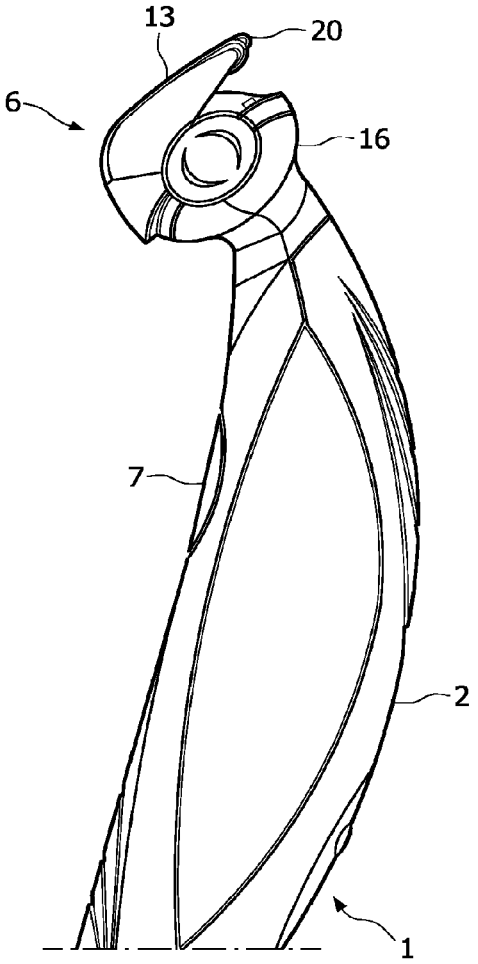
Figure 3B:
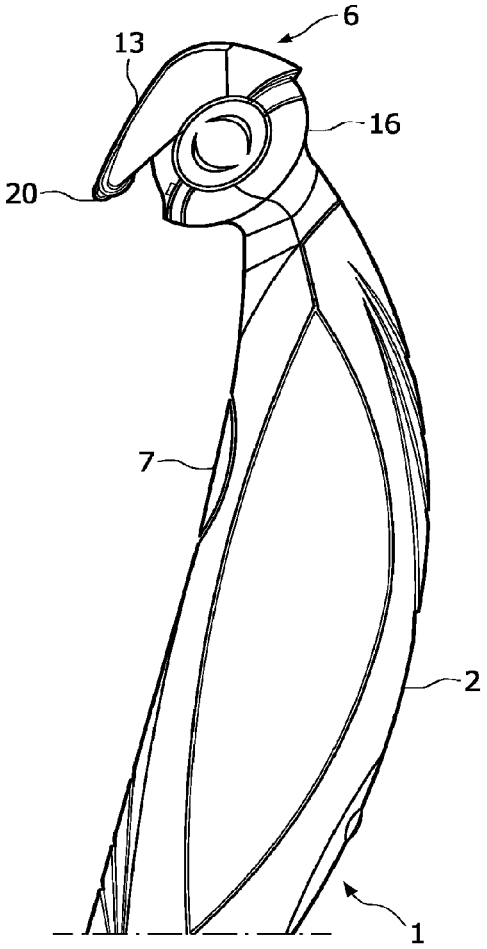
Figure 4A:
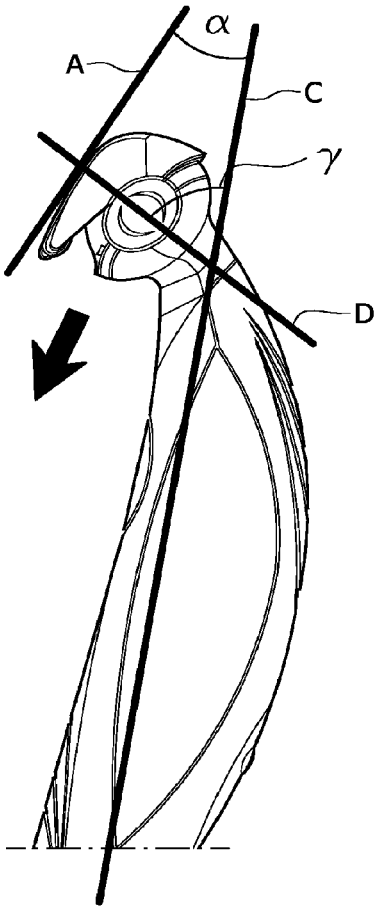

A detailed description of the invention is provided below. Said description is provided by way of non-limiting example to be read with reference to the attached drawings in which:

FIG. 1*a* shows a sketch of a first embodiment of the present invention with the comb unit in a pulling position;

FIG. 1*b* shows a sketch of the first embodiment with the comb unit in a pushing position;

FIG. 2*a* shows a sketch of a second embodiment of the present invention with the comb units in pulling positions;

FIG. 2*b* shows a sketch of the second embodiment with the comb unit in pushing positions;

FIG. 3*a* shows a third embodiment of the present invention with the comb unit in a pushing position;

FIG. 3*b* show the third embodiment with the comb unit in a pulling position;

FIG. 4*a* illustrates the geometric design of the embodiment according to FIG. 3*b;*

Figure 4B:
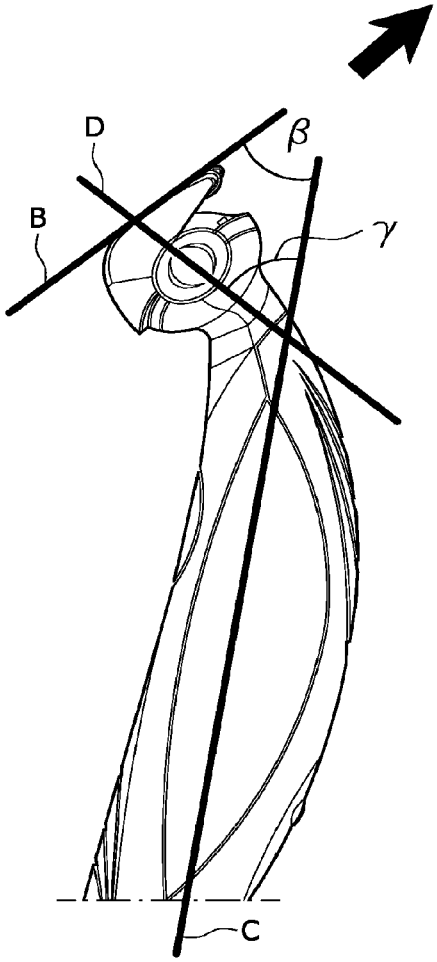

FIG. 4*b* illustrates the geometric design of the embodiment according to FIG. 3*a;*

Figure 5A:
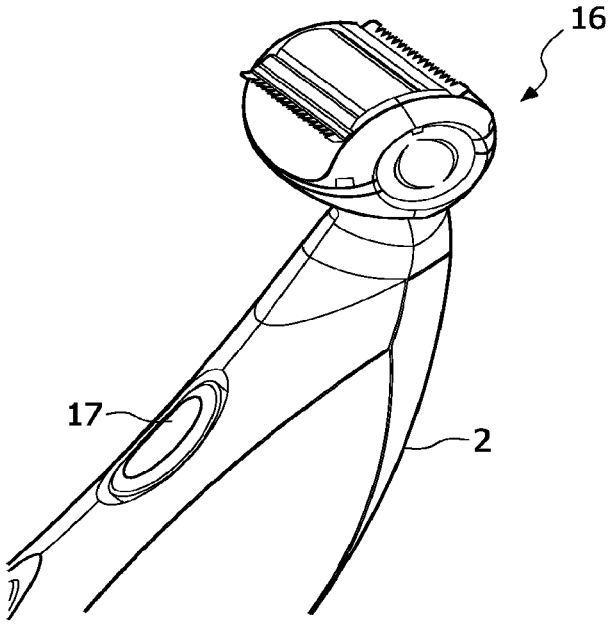
Figure 5B:
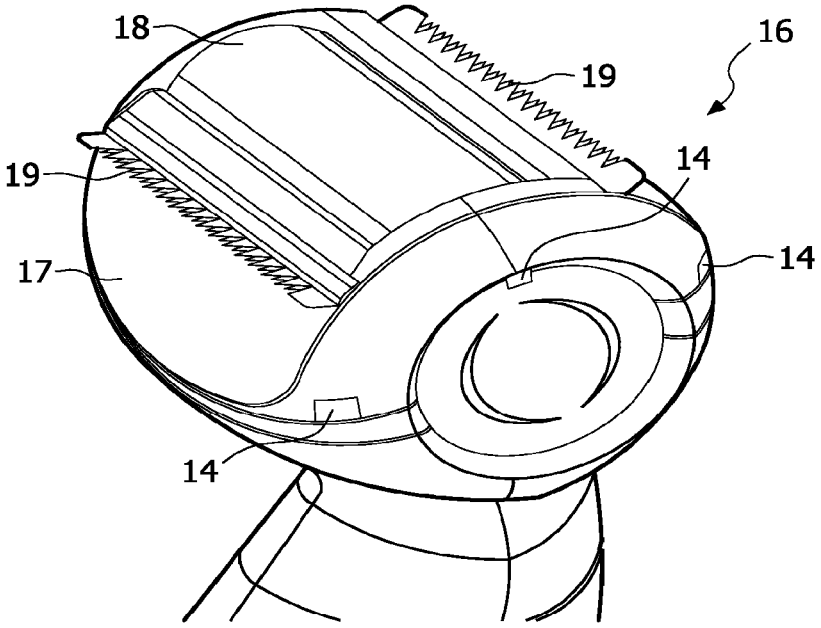

FIG. 5*a* shows the third embodiment without a comb unit;

FIG. 5*b* shows an enlarged detail of FIG. 5*a;*

Figure 6A:
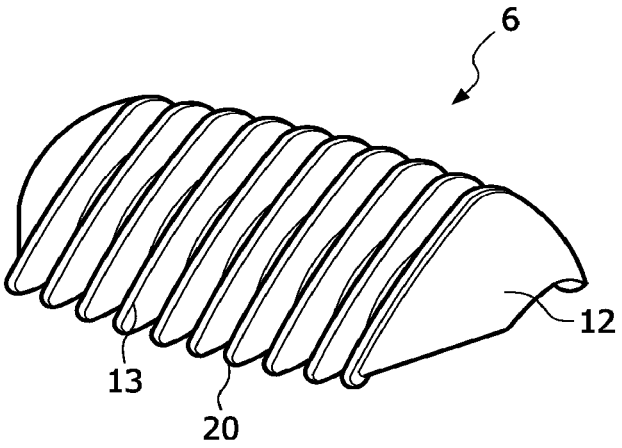
Figure 6B:
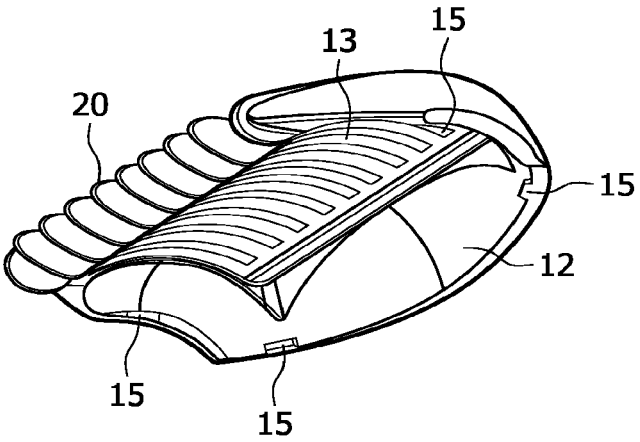

FIG. 6*a* shows a first perspective view of the comb unit of the third embodiment; and FIG. 6*b* shows a second perspective view of the comb unit of the third embodiment.

FIGS. 1*a* and 1*b* illustrate a first embodiment of the present invention. The hair trimmer device 1 has a hand grip 2 with its upper part being a trimming head 3 (in dotted lines, because it is hidden by the comb unit). The trimming head 3 includes a trimming means 4, e.g. a blade or a blade set. Removably attached over the trimming head 3 is the comb unit 6. The comb unit 6 can be attached in two different positions 8 and 9, position 8 being for trimming body hair by pulling the hair trimmer device 1 as shown in FIG. 1*a*, and position 9 being for trimming body hair by pushing the hair trimmer device 1 as shown in FIG. 1*b*. The user has the possibility to switch between pulling and pushing by just changing the position of the comb unit 6.

The comb unit 6 has fins 13, the tips 20 of which point in the direction of the respective movement (see arrows indicating the movements' directions). The orientation of the fins 13 is equivalent to the respective movement's direction as the fins 13 contact the skin during the trimming process. With the fins' tips 20 pointing in the direction of movement, it is made sure that the fins 13 efficiently penetrate the hair and make it all stand upright to achieve a uniform cutting length.

The orientation of the fins 13 or the direction of movement corresponds to the axis A, if the comb unit 6 is in the pulling position 8 (see FIG. 1*a*), or to the axis B, if the comb unit 6 is in the pushing position 9 (see FIG. 1*b*). The main body or hand grip 2 has an orientation corresponding to axis C. Axis A and axis C form the angle $\alpha=30°$, and axis B and axis C form the angle $\beta=54°$. $\beta$ is larger than $\alpha$, because it has been found that from an ergonomic point of view, it is handier to have a smaller angle for pulling applications and a larger angle for pushing applications.

FIGS. 2*a* and 2*b* show a second embodiment of the present invention. Here, the trimming head 3 (again hidden by the comb unit 6) has two trimming means 4 and 5, for example bladesets. Trimming means 4 is used, if the hair trimmer device 1 is pulled (see FIG. 2*a*), and trimming means 5 is used, if the hair trimmer device 1 is pushed (see FIG. 2*b*). The trimming head 3 is designed as a removable part, to allow to exchange it with a new one in case the bladesets 4 and 5 have become blunt.

The comb unit 6 is attached in a way that its position can be changed by pivoting it. Four different positions 8, 9, 10, 11 are provided, positions 8 and 10 (dashed line) for a pulling application (see FIG. 2*a*) and positions 9 and 11 (dashed line) for a pushing application (see FIG. 2*b*). The different positions 8, 9, 10, 11 lead to different angles $\alpha$ or $\beta$ respectively. In the present example $\alpha$ may be 23° or 38° and $\beta$ may be 53° and 63°. Providing more than two possible positions has the advantage that the user can choose his/her preferred angle individually and adapt it e.g. to the body zone to be trimmed As the comb unit 6 is pivoted it may be attached irremovably, and then preferably to the main body or handgrip 2 for not hindering the removal of the trimming head 3.

FIGS. 3*a* and 3*b* illustrate a third embodiment of the present invention. The main body of the hair trimmer device 1 is formed as handgrip 2. The device 1 is switched on with the help of the switch 7 and is powered by a battery or accumulator arranged in the handgrip 2 or with the help of a power cord. The shaving head 16 has not the same orientation as the handgrip 2 to increase accessibility during hair removal. A removable comb unit 6 is attached to the shaving head 16 either with the tips 20 of its fins 13 pointing upwards for a pushing application (see FIG. 3*a*) or with the tips 20 pointing downwards for a pulling application (see FIG. 3*b*).

The axes defined by the orientations of the fins 13, the shaving head 16 and the handgrip 2 of the third embodiment and the resulting angles are shown in FIGS. 4*a* and 4*b*. For a pulling application, as illustrated in FIG. 4*a*, the axis C of the handgrip 2 and the axis A of the fins 13 form the angle $\alpha=20°$. For the pushing application, as illustrated in FIG. 4*b*, the axis C of the handgrip 2 and the axis B of the fins form the angle $\beta=50°$. In addition, there is a constant angle $\gamma=60°$ between the axis C of the handgrip and the axis D corresponding to the orientation of the shaving head 16.

The shaving head 16 is illustrated more in detail in FIGS. 5*a* and 5*b*. FIG. 5*a* shows the hair trimmer device without the comb unit. The shaving head 16 itself is shown enlarged in FIG. 5*b*. The lower half of shaving head 16 is an integral part of the handgrip 2, the upper part consists of a cutter unit 17 that is removably attached to the lower part of the shaving head 16 to allow replacement. The essential parts of the cutter unit 17 are two pre-trimmers 19 arranged on either side of a shaving foil 18. Thus, the user can utilize the hair trimmer device by first pre-trimming body hair with the help of the attached comb unit by pulling the device and cutting the hair with the left-hand pre-trimmer 19 or by pushing the device and cutting the hair with the right-hand pre-trimmer 19. Then, the user removes the comb unit and removes the remaining hair stubbles by shaving them with the help of the shaving foil 19.

It will be understood by the person skilled in the art that using a shaving foil is only one possibility. One could as well use revolving shaving means.

An important feature are the notches 14. Their function is to provide attachment point for the comb unit. As will be seen in FIG. 6*b*, the comb unit has two lugs on either side. When attaching the comb unit, one lug is always inserted into the middle notch and the other lug is inserted into either the right-hand notch 14 or into the left-hand notch 14, depending on whether the comb unit is to be attached by snapping in the pull position or in the push position.

FIGS. 6*a* and 6*b* show the comb unit 6 in more detail. In between a side wall 12 is an array of parallel fins 13 with rounded tips 20 to avoid injury to the user's skin, especially, when removing the hair from a sensitive body zone, e.g. arm pits or pubic region. FIG. 6*b* illustrates the fact that the side wall 12 has a shell-like shape to encompass the trimming head or shaving head in the attached state. On the inside of the side wall 12, lugs 15 are arranged, two of them on opposite sides. When attaching the comb unit 6, the lugs 15 are introduced into the notches shown in FIG. 5*b*.

It will be noted that irrespective of the fact that only a single component comb unit is shown in the drawing, the comb unit may as well be a multi component comb unit as described for example in EP 1 216 799 A2. It will further be noted that a comb unit providing pulling as well as pushing movements without adjusting its position when attached to the hair trimmer device would be rather bulky compared to the comb unit according to the present invention, because such a comb unit would be approximately twice as large to ensure a comparable combing effect, and thus poor from a point of view of ergonomics.

Although having described several preferred embodiments of the invention, those skilled in the art would appreciate that various changes, alterations, and substitutions can be made without departing from the spirit and concept of the present invention. The invention is, therefore, claimed in any of its forms or modifications with the proper scope of the appended claims. For example various combinations of the features of the following dependent claims could be made with the features of the independent claim without departing from the scope of the present invention. Furthermore, any reference numerals in the claims shall not be construed as limiting their scope.

LIST OF REFERENCE NUMERALS

1 hair trimmer device
2 hand grip
3 trimming head
4 first trimming means
5 second trimming means
6 comb unit
7 switch
8 first position
9 second position
10 third position
11 fourth position
12 side wall
13 fins
14 notch
15 lug
16 shaving head
17 cutting unit
18 shaving foil
19 pre-trimmer
20 tip of fin
$\alpha$ angle
$\beta$ angle
$\gamma$ angle
A axis
B axis
C axis
D axis

The invention claimed is:

1. A device, comprising:

a main body;

a trimming head; and a comb disposed on the trimming head, wherein an orientation of the comb is positionable between at least two different positions defined by predetermined angles, the predetermined angles being measured by an angle between an axis of the comb and an axis of the main body, wherein a first of the predetermined angles is between about 0° and 40°, and wherein a second of the predetermined angles is between about 30° and 70°, wherein the first of the predetermined angles is selected to enable the device to be pulled in a pulling direction along a surface to be treated by the trimming head, and wherein the second of the predetermined angles is selected to enable the device to be pushed in a pushing direction along the surface, wherein the comb comprises a row of fins, and wherein the row of fins is positioned such that the fins point in the pulling direction when the comb is positioned in the first of the predetermined angles, and such that the fins point in the pushing direction when the comb is positioned in the second of the predetermined angles.

2. A device, comprising:

a main body;

a trimming head comprising two trimming means and a shaving means disposed between the two trimming means; and a comb disposed on the trimming head, wherein an orientation of the comb is positionable between at least two different positions defined by predetermined angles, the predetermined angles being measured by an angle between an axis of the comb and an axis of the main body, wherein a first of the predetermined angles is between about 0° and 40°, and wherein a second of the predetermined angles is between about 30° and 70°.

3. A device, comprising:

a main body;

a trimming head, wherein the trimming head is immovably fixed with respect to the main body in a trimming configuration; and a comb disposed on the trimming head, wherein the comb positionable with respect to the trimming head, wherein an orientation of the comb is positionable between at least two different positions defined by predetermined angles, the predetermined angles being measured by an angle between an axis of the comb and an axis of the main body, wherein a first of the predetermined angles is between about 0° and 40°, and wherein a second of the predetermined angles is between about 30° and 70°, wherein the first predetermined angle corresponds to a configuration where the device is pulled to perform trimming.

4. The device of claim 3, wherein the comb comprises a row of fins, and wherein the axis of the comb is defined based on an orientation of the fins.

5. The device of claim 3, wherein the first of the predetermined angles is smaller than the second of the predetermined angles.

6. The device of claim 3, wherein the first of the predetermined angles is selected to enable the device to be pulled in a pulling direction along a surface to be treated by the trimming head, and wherein the second of the predetermined angles is selected to enable the device to be pushed in a pushing direction along the surface.

7. The device of claim 6, wherein the comb comprises a row of fins, and wherein the row of fins is positioned such that the fins point in the pulling direction when the comb is positioned in the first of the predetermined angles, and such that the fins point in the pushing direction when the comb is positioned in the second of the predetermined angles.

8. The device of claim 3, wherein the trimming head comprises a shaving means.

9. The device of claim 3, wherein the trimming head comprises two trimming means.

10. The device of claim 9, wherein the trimming head further comprises a shaving means disposed between the two trimming means.

11. The device of claim 3, wherein the trimming head is removable from the main body to allow an exchange with a new trimming head.

12. The device of claim 3, wherein the second predetermined angle corresponds to a configuration where the device is pushed to perform trimming.

13. The device of claim 3, wherein each of the at least two different positions includes a plurality of positions defined by the predetermined angles.

* * * * *